US008545941B2

(12) United States Patent
Nakamoto et al.

(10) Patent No.: US 8,545,941 B2
(45) Date of Patent: Oct. 1, 2013

(54) METHOD OF DRYING COATING LIQUID AGENT AND APPARATUS THEREFOR

(75) Inventors: Shunichiro Nakamoto, Osaka (JP); Tadayuki Mukai, Osaka (JP); Yuji Sekiguchi, Osaka (JP)

(73) Assignee: Nakamoto Packs Co., Ltd., Osaka-shi (JP)

( * ) Notice: Subject to any disclaimer, the term of this patent is extended or adjusted under 35 U.S.C. 154(b) by 148 days.

(21) Appl. No.: 13/286,683

(22) Filed: Nov. 1, 2011

(65) Prior Publication Data

US 2013/0108794 A1 May 2, 2013

(51) Int. Cl.
*B05D 3/02* (2006.01)

(52) U.S. Cl.
USPC ..... 427/374.1

(58) Field of Classification Search
USPC ..... 427/374.1
See application file for complete search history.

(56) References Cited

U.S. PATENT DOCUMENTS

| | | | | | |
|---|---|---|---|---|---|
| 1,463,923 | A | * | 8/1923 | Nelson | 34/629 |
| 2,168,051 | A | * | 8/1939 | Smith et al. | 430/538 |
| 3,056,593 | A | * | 10/1962 | Timson | 432/59 |
| 4,208,460 | A | * | 6/1980 | Knechtle et al. | 428/195.1 |
| 4,231,164 | A | * | 11/1980 | Barbee | 34/452 |
| 4,625,430 | A | * | 12/1986 | Aula et al. | 34/392 |
| 5,320,334 | A | * | 6/1994 | DeAngelis | 270/4 |
| 6,079,330 | A | * | 6/2000 | Aoki et al. | 101/424.1 |
| 6,401,609 | B1 | | 6/2002 | Fukumori et al. | |
| 6,481,118 | B1 | * | 11/2002 | De Vroome | 34/461 |
| 6,998,021 | B2 | * | 2/2006 | Mantyla et al. | 162/263 |
| 2005/0025889 | A1 | * | 2/2005 | Yago | 427/314 |
| 2007/0084542 | A1 | * | 4/2007 | Montagna et al. | 156/160 |

FOREIGN PATENT DOCUMENTS

| | | | |
|---|---|---|---|
| JP | 02030535 | A * | 1/1990 |
| JP | 6-220385 | A | 8/1994 |
| JP | 2000-153582 | A | 6/2000 |
| JP | 2001-30611 | A | 2/2001 |
| JP | 2002-88662 | A | 3/2002 |
| JP | 2002-96448 | A | 4/2002 |
| JP | 2005-48046 | A | 2/2005 |

* cited by examiner

*Primary Examiner* — Nathan Empie
(74) *Attorney, Agent, or Firm* — Birch, Stewart, Kolasch & Birch, LLP

(57) ABSTRACT

In an oven used for printing machine and the like, drying is rendered possible to be conducted without decreasing traveling speed (120 m/min or more) by a short and compact drying zone for a coating liquid agent which is made aqueous as well as oily coating liquid agent. A plurality of hot air blow-off nozzles 222 are provided in the drying portion 220 of the first printing unit 200. Heating guide rolls 223*a* are provided at the former portion, and cooling guide rolls 223*b* are provided at the latter portion, so that they meet the hot air blow-off nozzles 222. Liquid delivery pipes 224*a* for injecting hot water are connected to the heating guide rolls 223*a*, and liquid delivery pipes 224*b* for injecting cooling water are connected to the cooling guide rolls 223*b*. Introduced raw web 1 is heated to the boiling point of solvent or higher than that by the heating guide rolls 223*a*.

4 Claims, 6 Drawing Sheets

Drying Characteristic Curve

METHOD OF DRYING COATING LIQUID AGENT AND APPARATUS THEREFOR

TECHNICAL FIELD

This invention relates to a drying method for a drying oven in a gravure printing machine, a dry laminating machine, a coating machine and the like, and more particularly, relates to a drying method wherein a liquid agent produced by dissolving an aqueous or solvent-characteristic component is applied to a substrate, such as a packaging material, by a gravure roll or the like, and then, the liquid agent side is dried in a drying oven by blowing hot air while conveying the substrate of which the side opposite to the side onto which the liquid agent has been applied is in contact with guide rolls.

BACKGROUND ART

Gravure printing machines, dry laminating machines, coating machines, and the like have a drying oven as a principal constitution part. For example, in multicolor gravure printing machines, ink dissolved in a solvent is applied to a substrate by a gravure roll in the first color printing unit, followed by evaporating the solvent in a drying oven to solidify the ink alone on the substrate and cooled, and then transferred to the second color printing unit. Printing is carried out through similar processes in the second and thereafter printing units up to the final printing unit, to complete the substrate provided with multi-color printing, and finally wound up.

Moreover, in dry laminating machines, to unwound substrate A, an adhesive dissolved in a solvent is applied by a gravure roll, followed by evaporating the solvent in a drying oven, a substrate B is superimposed on the face where the adhesive has been applied, and pressed to form a laminate, and wound up. In coating machines, a coating solution dissolved in a solvent is applied to a substrate by a gravure roll, followed by evaporating the solvent in a drying oven, cooled, and then wound up.

The drying ovens employed in the above respective machines are constructed by almost similar mechanism. That is, in the drying ovens, a plurality of guide rolls are provided, and the substrate to which a liquid agent has been applied is dried by blowing hot air with being guided by the guide rolls. While, the opposite side of the substrate to which the liquid agent has been applied is allowed to contact with the guide rolls, and the side on which the liquid agent has been applied is dried by heat by blowing hot air.

Recently, printings and laminatings are being transferred to aqueous gravure printing and aqueous dry laminating, where solvent is not used, due to the problems of bad smell while working, working atmosphere, residual solvent odor, reduction of $CO_2$ as a remedy for global warming caused by oil solvent (e.g., see Patent Documents 1-6).

PRIOR ART DOCUMENT

Patent Document

[Patent Document 1] Japanese Patent 3249223
[Patent Document 2] JP 2001-030611 A
[Patent Document 3] JP 2002-096448 A
[Patent Document 4] JP 2000-153582 A
[Patent Document 5] JP 2002-88662 A
[Patent Document 6] JP 2005-48046 A

SUMMARY OF THE INVENTION

Problems to be Solved by the Invention

However, in the aforementioned conventional drying ovens, since necessary heat for drying substrate is supplied only by hot air, it is necessary to continue to supply heat for a definite time or more in order to supply heat of a definite quantity or more which is necessary for drying. It renders the drying oven having a long travel distance due to drying the substrate without descending production speed.

That is, in order to dry the liquid agent applied onto the substrate, it is necessary to dry it with compensating evaporation latent heat, by elevating the temperature of the liquid agent to evaporate the solvent. However, even when hot air is blown toward the liquid agent side applied onto the substrate, the temperature of the liquid agent does not rise unless the temperature of the substrate is raised. Accordingly, for elevating the temperature of the substrate and that of the liquid agent, a time is needed to a certain degree, because hot air is gas having a small heat capacity. Particularly, in the case of water-soluble gravure printing and aqueous dry laminating, since water is used which has a greater evaporation latent heat compared with oil solvent, it is a very big problem.

Properties of major solvents are shown in Table 1.

TABLE 1

| Solvent Name | Molecular Weight | Boiling Point (° C.) | Flashpoint (closed) (° C.) | Evaporation Latent Heat (boiling point) (KJ/kg) (cal/g) | Vapor Pressure (20° C.) (Pa) (mmHg) | Surface Tension (25° C.) (mN/m) (dyne/cm) | Solubility Parameter (Hansen) |
|---|---|---|---|---|---|---|---|
| Toluene | 92.1 | 110.6 | 4.4 | 363.6<br>86.9 | 4000<br>30.0 | 27.9 | 8.91 |
| Ethyl Acetate | 88.1 | 76.7 | −7.2 | 369<br>88.2 | 9706<br>72.8 | 23.8 | 9.10 |
| Methyl Ethyl Ketone | 72.1 | 79.6 | −4.0 | 439<br>105.2 | 9493<br>71.2 | 24.0 | 9.27 |
| Isopropanol | 60.1 | 82.3 | 11.7 | 666<br>159.2 | 4320<br>32.4 | 21.7* | 11.50 |
| n-Propanol | 60.1 | 97.1 | 15.0 | 680<br>162.6 | 1933<br>14.5 | 23.8* | 11.97 |
| Ethanol | 46.7 | 78.3 | 16.0 | 833<br>199.2 | 7999<br>60.0 | 22.1 | 12.92 |
| Water | 18.0 | 100.0 | — | 2456<br>586.9 | 2333<br>17.5 | 71.8 | 23.50 |

*20° C.

As shown in Table 1, since evaporation latent heat of water is very great, it needs to supply a greater quantity of heat for drying aqueous coating liquid agent than the case of oily coating liquid agent. Therefore, drying of aqueous coating liquid agent is addressed by lengthening the drying zone or slowing down the traveling speed so as to take a longer retention time than the case of the oily one in the drying oven.

The present invention was made in order to solve the above problems, and the object of the invention is to provide a drying method capable of drying aqueous coating liquid agent as well as oily coating liquid agent without decreasing traveling (producing) speed (120 m/min or more) by a compact drying zone shorter than a conventional drying zone, and an apparatus therefor.

As a result of investigating eagerly in order to solve the above problems, the inventors noted that vaporization of solvent becomes faster by rendering the drying temperature of the coating liquid agent at the boiling point of the solvent in the coating liquid agent or higher than that, and they found a means of making the drying temperature of the coating liquid agent to the boiling point of the solvent or higher than that rapidly, to complete the invention.

That is, guide rolls provided in the drying oven are heated, and the temperature of the substrate is raised up to the boiling point or higher than that in a short period, by heating the opposite side to the solvent-applied side of the introduced substrate by the heated guide rolls as well as heating by hot air, and thereby, the temperature of the coating liquid agent is also raised up to the boiling point or higher than that in a short period. In addition, once the temperature of the substrate is elevated by the heated guide rolls, the temperature of the substrate is further raised by blowing hot air for drying to generate deformation, such as elongation, contraction, and waviness. Therefore, in order to avoid the deformation, the latter portion of guide rolls are cooled, and further temperature elevation of the substrate is inhibited by the cooling rolls.

As mentioned above, among a plurality of guide rolls, plural guide rolls in the former portion are made heating guide rolls, and plural guide rolls in the latter portion are made cooling rolls. Thereby, the temperature of the coating liquid agent is made at the boiling point or higher immediately after entering the drying oven to dry it efficiently, and the temperature of the substrate is kept preferable so as not to be too high to inhibit deformation of the substrate.

The method of drying a coating liquid agent relating to claim 1 comprises, applying uniformly a liquid agent made by dissolving an aqueous or solvent-characteristic component to a substrate by a coating roll, and then, blowing hot air toward the liquid agent-applied side while conveying the substrate with contacting a plurality of guide rolls with the opposite side to the liquid agent-applied side in a drying oven, wherein former portion of the plurality of guide rolls is made heating guide rolls, and remaining latter portion is made cooling guide rolls, the substrate immediately after entering the drying oven is heated by the heating guide rolls to render it at a temperature of boiling point of water or solvent or higher than that, and thereafter, the substrate is cooled by the cooling guide rolls so as to keep a temperature where the substrate is not deformed.

The method of drying a coating liquid agent relating to claim 2 comprises detecting temperature of substrate before drying, and adjusting temperature of the cooling guide rolls so that temperature of the substrate after drying is made similar to the detected temperature of the substrate before drying.

The method of drying a coating liquid agent relating to claim 3 comprises heating guide rolls by injecting hot water or heating oil, and cooling said cooling guide rolls by injecting cooling water.

The method of drying a coating liquid agent relating to claim 4 comprises forcing heating guide rolls and cooling guide rolls to drive to synchronize them with conveying speed of the substrate.

The drying apparatus for a coating liquid agent relating to claim 5 which comprises, applying uniformly a liquid agent made by dissolving an aqueous or solvent-characteristic component to a substrate by a coating roll, and then, blowing hot air toward the liquid agent-applied side while conveying the substrate with contacting a plurality of guide rolls with the opposite side to the liquid agent-applied side in a drying oven, wherein former portion of said guide rolls is formed of heating guide rolls, and remaining latter portion is formed of cooling guide rolls.

The drying apparatus for a coating liquid agent relating claim 6 comprises providing a detecting means for detecting temperature of said substrate before drying, and a controller to which temperature information detected by the temperature detecting means is input and which controls temperature of the cooling guide rolls so that temperature of the substrate after drying is made similar to the temperature before drying by the input temperature information.

The drying apparatus for a coating liquid agent relating to claim 7 comprises being provided with a heating means to inject hot water or heating oil into heating guide rolls and a cooling means to inject cooling water into said cooling guide rolls.

The drying apparatus for a coating liquid agent relating to claim 8 comprises being provided with a belt for driving said heating guide rolls and cooling guide rolls and a motor for driving the belt.

Effects of the Invention

In the drying method of a coating liquid agent relating to claim 1, since former portion of the plurality of guide rolls is constituted by heating guide rolls to heat the substrate immediately after entering the drying oven, temperature of liquid agent can be made at a temperature of boiling point of water or solvent or higher than that in a very short period. Therefore, the constant rate drying period (II) in the drying characteristic curve shown in FIG. 7 can be reached in a short period to improve drying efficiency greatly. This is caused by greater heat capacity of guide rolls being solid than hot air being gas, and thereby, a large quantity of heat can be supplied to the substrate in a short time. When heated only by hot air, a time is required for preheating the substrate, and the preheating time acts greatly on the traveling (production) speed. In addition, since the substrate is cooled by the cooling guide rolls in the latter portion, the temperature elevation of the substrate is inhibited to be able to maintain a temperature where the substrate is not deformed. Accordingly, elongation, contraction, deformation and the like do not occur in the substrate.

In the drying method of a coating liquid agent relating to claim 2, since the temperature of the substrate before drying is detected to adjust the temperature of cooling guide rolls so that the temperature of the substrate after drying is made similar to the detected temperature of the substrate before drying, elongation, contraction, deformation and the like of the substrate can be surely inhibited.

In the drying method of a coating liquid agent relating to claim 3, since heating is carried out by injecting hot water or heating oil into the heating guide rolls and cooling is carried out by injecting cooling water into the aforementioned cooling guide rolls, the heating guide rolls can be heated easily, and the adjustment of heating temperature can be simplified. Moreover, the cooling guide rolls can be easily cooled, and the adjustment of cooling temperature can be simplified.

In the drying method of a coating liquid agent relating to claim 4, since the heating guide rolls and the cooling guide rolls are forced to drive to synchronize them with the conveying speed of the substrate, the substrate can be conveyed without rubbing by the contact with the guide rolls.

In the drying apparatus for a coating liquid agent relating to claim 5, since the substrate can be heated by the heating guide rolls formed in the former portion of guide rolls, the temperature of the substrate and the temperature of the coating liquid agent immediately after entering can be raised at a temperature of the boiling point of the solvent or higher than that in a short time. Moreover, since the substrate can be cooled by the cooling guide rolls formed in the latter portion of guide rolls, temperature elevation up to a temperature, where elongation, contraction, deformation and the like generate, can be prevented.

In the drying apparatus for a coating liquid agent relating to claim 6, since a detecting means for detecting the temperature of the substrate before drying, and a controller to which a temperature information detected by the temperature detecting means is input to control the temperature of the cooling guide rolls so that the temperature of the substrate after drying is made similar to the temperature before drying by the input temperature information, the temperatures of the substrate before and after drying are ensured to be almost the same, and elongation, contraction, deformation and the like can be surely prevented.

In the drying apparatus for a coating liquid agent relating to claim 7, since a heating means to inject hot water or heating oil into the heating guide rolls, and a cooling means to inject cooling water into the cooling guide rolls are provided, the heating guide rolls can be heated easily, and the adjustment of heating temperature can be simplified. Moreover, the cooling guide rolls can be easily cooled, and the adjustment of cooling temperature can be simplified.

In the drying apparatus for a coating liquid agent relating to claim 8, since a belt for driving the heating guide rolls and the cooling guide rolls, and a motor for driving the belt are provided, the circumferential speeds of the heating guide rolls and the cooling guide rolls can be matched with the conveying speed of the substrate. As a result, the substrate can be conveyed without rubbing by the contact with the guide rolls.

MODE FOR CARRYING OUT THE INVENTION

The present invention relates to a method of drying a liquid agent applied onto a substrate, and the drying method is used for drying ovens which constitute a principal part of gravure printing machines, dry laminating machines, coating machines and the like. The drying in these apparatuses is carried out by introducing the substrate, onto which the liquid agent produced by dissolving an aqueous or solvent-characteristic component has been applied, into the drying oven, and evaporating water or solvent in the liquid to fix the dissolved component onto the substrate. The drying speed controls the performance (productivity) of the apparatus.

The type of the substrate is not critical, but in common, is a plastic film or sheet. Illustrative of the plastics are polyesters, such as PET and PEN, polyolefins, such as polyethylene and polypropylene, polyamides, polystylenes and the like, and metal foils, such as aluminum foil are also applicable. They may be laminated films or laminated sheets. The thickness of the substrate is, in general, about 5-500 μm, particularly about 7-400 μm.

Figure 7:
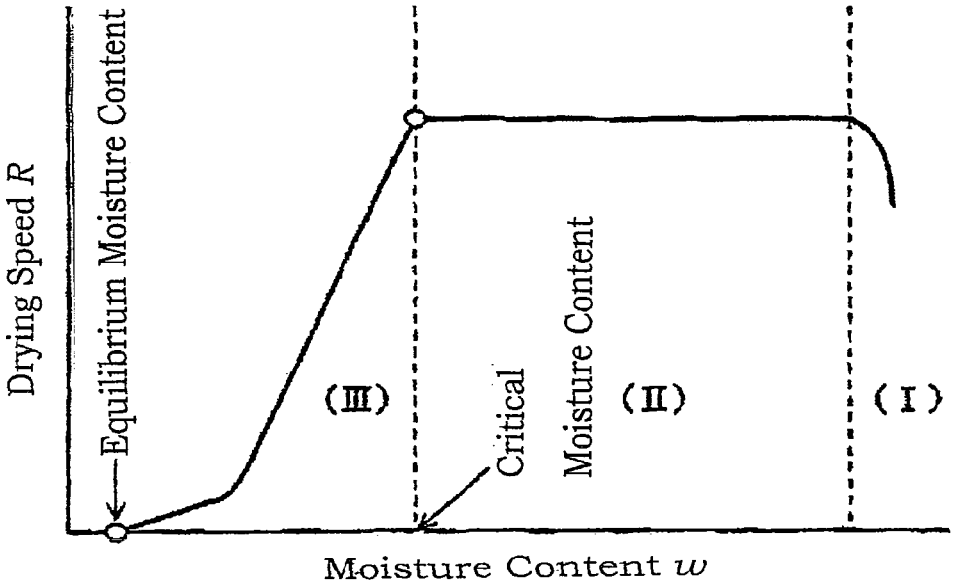
FIG. 7 Figure indicating a drying characteristic in curve

Generally, as shown by the drying characteristic curve in FIG. 7, drying is carried out through a material preheating period (I), a constant rate drying period (II) and a falling rate drying period (III). The material preheating period is the section where the temperature of material is raised up to the wet-bulb temperature, and variation of moisture is small in this section. The constant rate drying period is in a dynamic equilibrium where the heat transfer speed from the circumference is balanced with the evaporation speed from the material surface, and the drying speed R is constant in this section. The falling rate drying period is a section of the critical moisture content at the finish point of the constant rate drying period or less, and resistance to moisture migration in the material increases with decreasing moisture content, and drying speed falls thereby. For the purpose of drying rapidly in a short time, how fast to reach the constant rate drying period.

The coating liquid agent is liquid, and examples are inks for gravure printing, layers formed by dry laminating, coating materials for forming coatings, and the like. The coating liquid agent is composed of the object component to be applied and solvent component which dissolves or disperses it. The solvent component is aqueous or solvent-characteristic. The aqueous solvent component is a mixture of water and solvent, and the content of water is 30% by volume or more, particularly 40 vol. % or more. The solvent-characteristic solvent component is organic solvent that may be any one used in this field and that is not particularly limited. Illustrative of the solvent-characteristic solvents are those listed in the aforementioned Table 1, and mixtures containing any of them as the principal component. The boiling point of the solvent component corresponds to the constant rate drying temperature. In order to render the coating liquid agent at the temperature of boiling point, it is necessary to render the temperature of the substrate, to which the coating liquid agent has been applied, at the temperature of boiling point. Heretofore, heating was carried out by blowing hot air as the sole heat source toward the liquid agent coating side. However, since heat capacity of hot air is small due to being gas, a time is required for elevating the temperature of the substrate. However, when the former portion of guide rolls which convey the substrate is made heating guide rolls to heat the side of the substrate to be in contact therewith, since the heat capacity of solid is greater than that of gas, heating can be carried out quickly.

In the constant rate drying temperature (boiling point), heat is taken away by the evaporation latent heat shown in the aforementioned Table 1 by the evaporation of liquid, and thereby, the temperature of the substrate and also that of coated liquid agent do not rise exceeding those temperatures. However, when the constant rate drying state is passed, absorption of heat by evaporation latent heat does not occur. Therefore, the temperature of the substrate rises by the heat of hot air to induce elongation, contraction, deformation or the like. In order to prevent this, the latter portion of guide rolls is made cooling guide rolls to dissolve the heat supplied by hot air by the cooling guide rolls. That is, it is preferred that until finishing the constant rate drying period passing through the material preheating period, the substrate is heated by the heating guide rolls within the range of not higher than the boiling point where deformation and the like do not occur, and from the start of the falling rate drying period after finishing the constant rate drying period, the temperature is maintained in the range of not generating deformation or the like by inhibiting temperature elevation caused by hot air.

Although the total number of guide rolls in the drying oven is not particularly limited, it is around 10 in the oven for gravure printing, and around 20 in the oven for dry laminating or coating. Among them, the number of heating guide rolls is set so as to heat to the boiling point of the solvent component of the liquid agent applied onto the substrate or higher than that, together with the effects of hot air. In the case that the solvent component is a mixture, when it is an azeotropic mixture, the boiling point is that of the azeotropic mixture. Otherwise, it is the boiling point of the principal component, when solvent components can be removed to the degree of substantially not affecting the subsequent process by removing the principal component. On the other hand, the number of cooling guide rolls is set so that the temperature of the substrate can be made the temperature before drying, exactly the temperature before applying the liquid agent. The constitution ratio of the heating guide rolls to the cooling guide rolls in the total guide rolls in the drying oven varies depending on the type (aqueous, oily) of the coating liquid agent, thickness of the substrate, processing speed, the type of the apparatus (gravure printing, dry laminating, coating), and it is preferred to be set by conducting tests under these respective conditions. In brief, the ratio of the heating guide rolls is set around ⅕-⅓ of the number of the total guide rolls, and preferable conditions can be seeked by controlling the temperature of the guide rolls. In addition, the whole guide rolls may be made the heating guide rolls or the cooling guide rolls, or alternatively, a part of guide rolls may be made not having these functions.

The heating guide rolls are heated by injecting hot water or heating oil into the guide rolls, and are set at a desired temperature by adjusting the temperature, flow rate or the like. The temperature of the heating guide rolls does also vary depending on the type (aqueous, oily) of the coating liquid agent, thickness of the substrate, processing speed, the type of the apparatus (gravure printing, dry laminating, coating), and it is preferred to be set by conducting tests under these respective conditions.

The injection of hot water or heating oil can be conducted, for example, by connecting liquid delivery pipes so as to circulate hot water or heating oil through the guide rolls, and providing a heating portion for heating the hot water or heating oil and a liquid delivery portion capable of adjusting flow rate in the course of the liquid delivery pipes. Alternatively, hot water or heating oil may be injected from their supply sources by connecting liquid delivery pipes through a pump. The heating guide rolls may be connected as a whole or individually. Furthermore, when the heating guide rolls are connected individually with stop valves, heating conditions can be set in delicate by the on-off of them.

The cooling guide rolls are cooled by injecting cooling water into the guide rolls, and as a result, the substrate in contact with the cooling guide rolls is cooled. The injection of cooling water can be conducted, for example, by connecting liquid delivery pipes so as to circulate cooling water through the guide rolls and providing a cooling portion for cooling water and a liquid delivery portion capable of adjusting flow rate in the course of the liquid delivery pipes. Alternatively, cooling water may be injected from their supply sources by connecting liquid delivery pipes through a pump. The cooling guide rolls may be connected as a whole or individually.

It is preferred to force to drive the heating guide rolls and the cooling guide rolls to synchronize them with conveying speed of the substrate. The means for forcing to drive the guide rolls is, for example, driving the guide rolls by a belt to conform to the conveying speed of the substrate. In this case, a pulley having the same diameter as the diameter at the face coming in contact with the substrate of the guide roll is mounted at an end of each guide roll, and a belt is wound on the pulleys in common. Thereby, they can be easily matched with the conveying speed of the substrate.

The flow rate of cooling water being injected into the guide roll can be adjusted by the detected temperature of the substrate before drying so that the temperature of the substrate after drying is almost the same as that before drying. The temperature of the substrate can be detected by using a known temperature sensor or the like. The adjustment of the flow rate of cooling water by the detected temperature is carried out as follows: That is, by providing a controller wherein a relationship between temperature and flow rate has been input, and by transmitting the detected temperature to the controller, the controller controls a pump of cooling water or the like to adjust so as to render the prescribed flow rate of the cooling water.

An embodiment of a printing apparatus wherein the method of drying a coating liquid agent of the invention is applied to a multicolor gravure printing is explained with reference to drawings.

Figure 1:
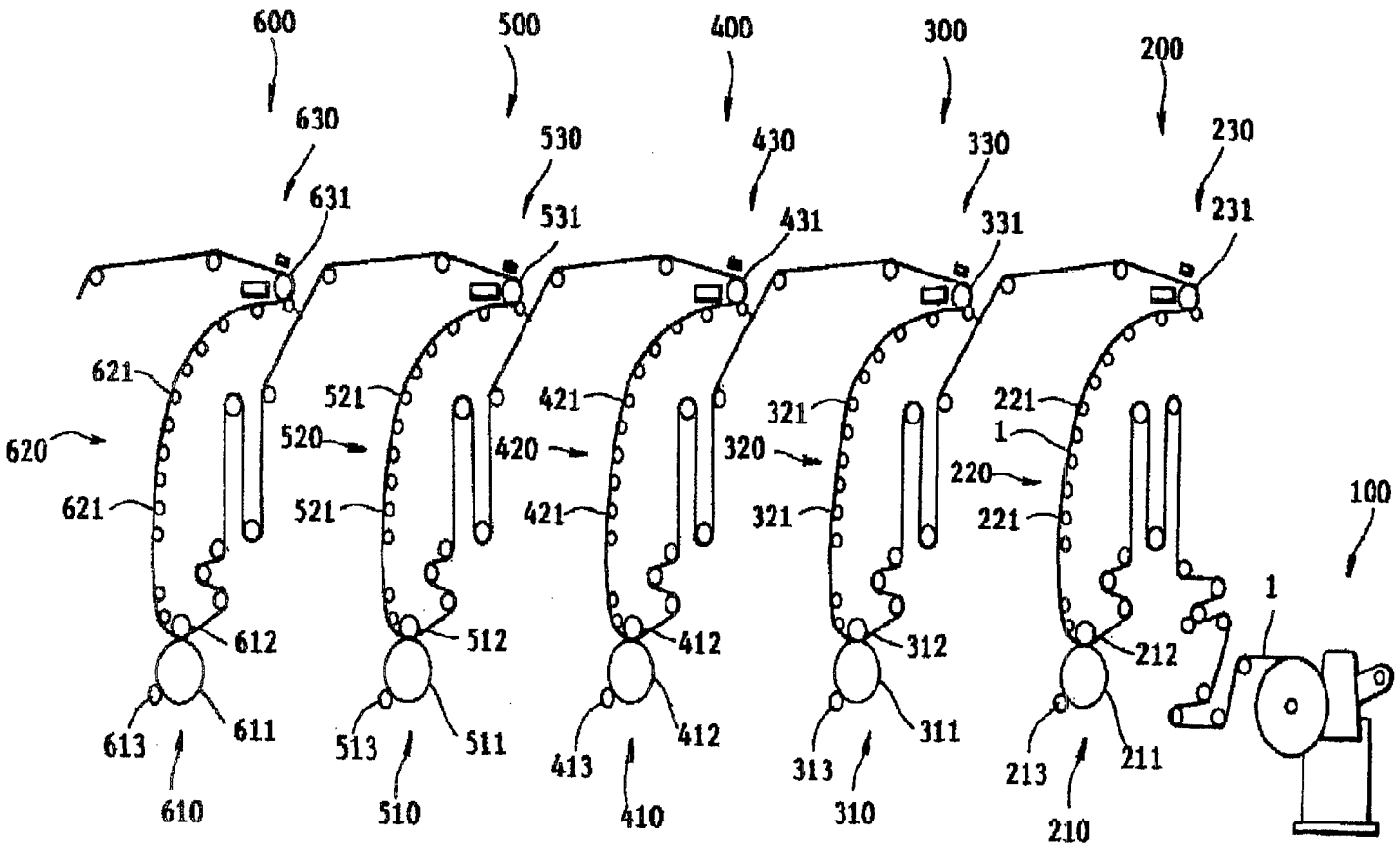
FIG. 1 Schematic general view of a multi-color gravure printing apparatus
Figure 2:
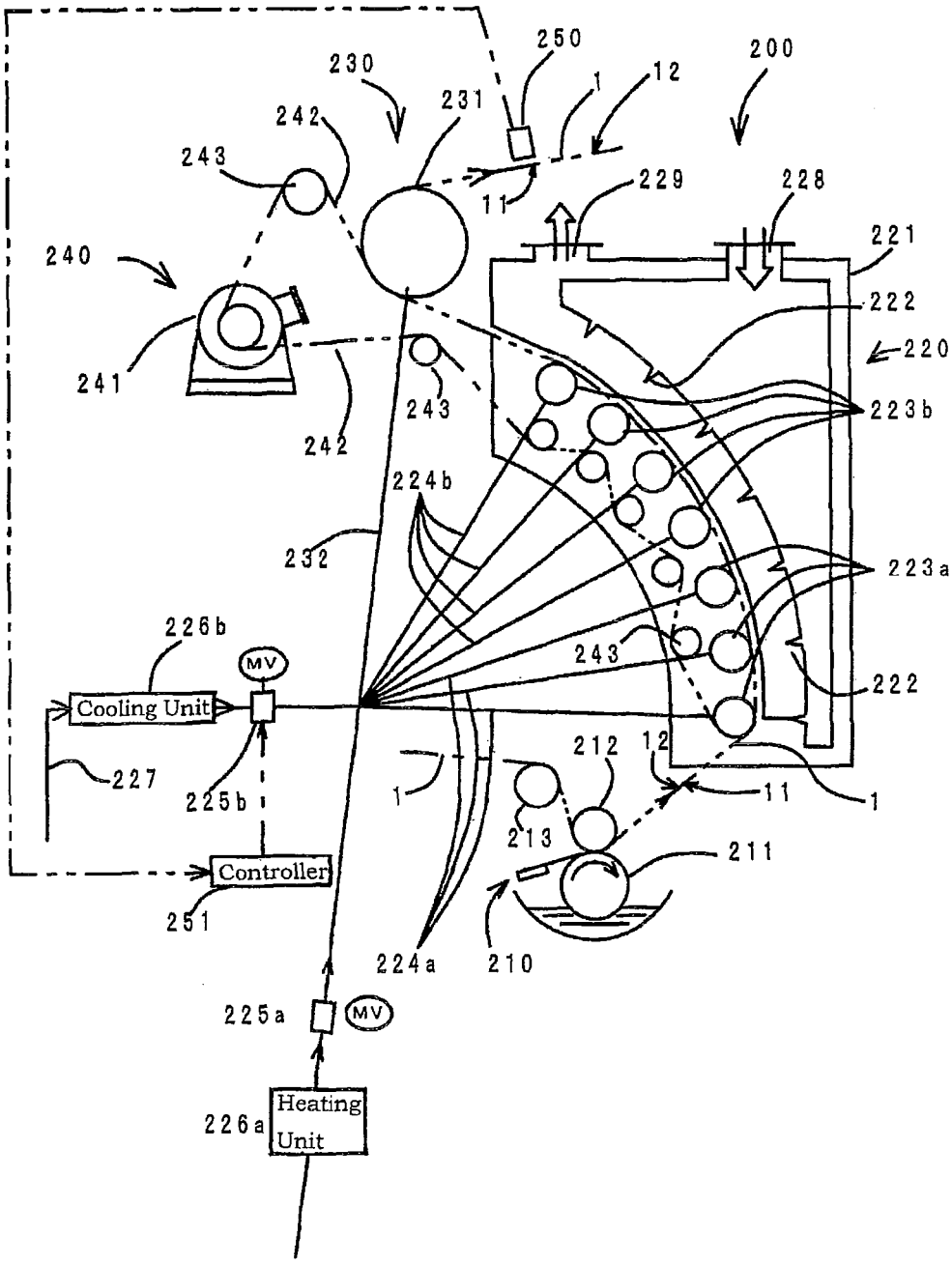
FIG. 2 Enlarged view of the first printing unit portion of the multi-color gravure printing apparatus FIG. 3 Schematic view of a dry laminating apparatus wherein three drying ovens are connected in series (three zones)

FIG. 1 is a schematic general view of the multicolor gravure printing apparatus, and FIG. 2 is an enlarged view of the first printing unit portion of the multicolor gravure printing apparatus.

In FIG. 1 and FIG. 2, 100 is a feeder that delivers the substrate 1 to the subsequent printing unit, 200 is the first printing unit for the first color, 300 is the second printing unit for the second color, 400 is the third printing unit for the third color, 500 is the fourth printing unit for the fourth color, and 600 is the fifth printing unit for the fifth color.

The first printing unit 200 for the first color is provided with a printing portion 210 where a print is added to the raw web 1, a drying portion where the printed raw web 1 is dried, and a cooling portion 230 where the raw web 1 is cooled. The printing portion 210 is provided with a plate cylinder 211, an impression cylinder 212 and a furnisher roll 213.

The drying portion 220 is provided with a drying box 221. In the drying box 221, a plurality of hot air blow-off nozzles 222 are provided at regular intervals, and heating guide rolls 223*a* are provided in the former portion and cooling guide rolls 223*b* are provided in the latter portion, so that they meet these hot air blow-off nozzles 222. To the heating guide roll 223*a*, liquid delivery pipes 224*a* for injecting hot water and discharge pipes (not illustrated) for discharging the hot water are connected. To the liquid delivery pipe 224*a*, a motor valve 225*a* for adjusting the flow rate of hot water and a heating unit 226*a* for heating water are also connected. A discharge pipe is connected to the heating unit 226*a* on the opposite side. As a result, hot water circulates through the heating unit 226*a*, the motor valve 225*a* and the heating guide roll 223*a*.

To the cooling guide roll 223*b*, liquid delivery pipes 224*b* for injecting cooling water and discharge pipes (not illustrated) for discharging the cooling water are connected. To the liquid delivery pipe 224*b*, a motor valve 225*b* for adjusting the flow rate of cooling water and a cooling unit 226*b* for cooling water are also connected. A discharge pipe is connected to the cooling unit 226*b* on the opposite side. As a result, cooling water circulates through the cooling unit 226*b*, the motor valve 225*b* and the guide roll 223*b*. In addition, 228 is an inlet port of hot air, and 229 is an exhaust port of hot air.

The cooling portion 230 is provided with a cooling roll 231 that is in contact with the printed face of the raw web 1 to cool it, and the cooling roll 231 is also connected to the motor valve 225*b* through a liquid delivery pipe 232, similarly.

240 is a driving portion of rolls for driving the guide rolls 223*a*, 223*b* and the cooling roll 231, and is provided with a driving motor 241, a belt 242 to be driven by the driving motor 241, and conveying rolls 243. The belt 242 is wound through the above guide rolls 223*a*, 223*b* and cooling roll 231. That is, the belt 242 is wound on pulleys (not illustrated) having the same diameter as the guide rolls 223*a*, 223*b*, and is simultaneously wound on a pulley (not illustrated) having the same diameter as the cooling roll 231. By driving the belt 242, the guide rolls 223*a*, 223*b* and the cooling roll 231 are allowed to rotate at the same circumferential speed, and the circumferential speed is set to be identical with the conveying speed of the raw web.

In the latter portion of the cooling portion 230, i.e. in the former portion of the printing portion 310 of the second printing unit 300, a temperature sensor 250 is mounted to detect the surface temperature of the raw web coming out from the cooling portion 230. The temperature sensor 250 is connected to a controller (not illustrated), and the controller commands to inject cooling water into the cooling guide rolls 223*b* and the cooling roll 231 with an injection volume which has previously been set, by the temperature signal from the temperature sensor 250.

Moreover, the second printing unit 300 for the second color, the third printing unit 400 for the third color, the fourth printing unit 500 for the fourth color, and the fifth printing unit 600 for the fifth color are also provided with a plate cylinder 311, 411, 511, 611, an impression cylinder 312, 412, 512, 612, a furnisher roll 313, 413, 513, 613, guide rolls 321-1, 321-2, 421-1, 421-2, 521-1, 521-2, 621-1, 621-2, and a cooling roll 331, 431, 531, 631, similar to the first printing unit for the first color.

When gravure printing is conducted using a multicolor gravure printing apparatus as above, the raw web 1 is delivered from the feeder 100 into the first printing unit 200 for the first color. The raw web 1 delivered to the printing unit 200 is first pressed at the printing portion 210 by the plate cylinder 211 and the impression cylinder 212 to be printed with the first color (e.g. printed with white all over). The raw web 1 is, at the drying portion 220, dried from the printed side 11 by hot air and simultaneously heated from the opposite side 12 to be printed by the heating guide rolls 223*a* in the former portion. Thereby, the raw web is heated up to near the boiling point of the solvent component. Subsequently, it is cooled by the cooling guide rolls 223*b* in the latter portion to inhibit temperature elevation than that.

In the cooling portion 230, it is wound around the cooling roll 231 to be cooled from the printed side 11. Therefore, the opposite side 12 to the printed side has already been cooled by the cooling guide rolls 223*b*, and the printed side 11 is cooled by the cooling roll 231. As a result, temperature elevation of the raw web 1 by hot air is inhibited by the cooling of the cooling guide rolls 223*b*, and finally, it is cooled by the cooling roll 231. Thus, the cooling is carried out efficiently as a whole. By the cooling, the raw web is made almost identical with the temperature of the substrate 1 at the time of printing in the printing portion 210.

Moreover, since the heating guide rolls 223*a*, the cooling guide rolls 223*b* and the cooling roll 231 are driven by the belt 242 so that the circumferential speed is made identical with the conveying speed of the raw web 1, the raw web 1 is conveyed without rubbing with the guide rolls 223*a*, 223*b* and the cooling roll 231, and therefore, without being affected adversely.

In the printing unit for the second color and after that, similar motions are repeated to provide the substrate with multicolor gravure printing composed of five colors to complete a gravure print.

An embodiment of the method of drying a coating liquid agent of the invention which is applied to dry laminating is explained with reference to drawings.

Figure 3:
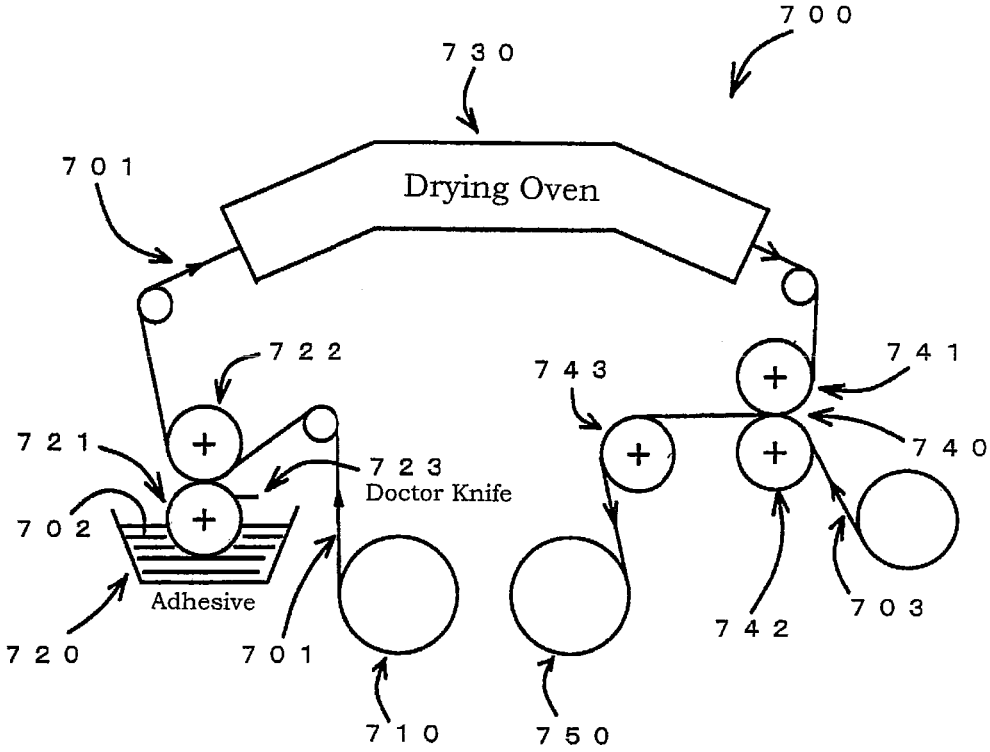
Figure 4:
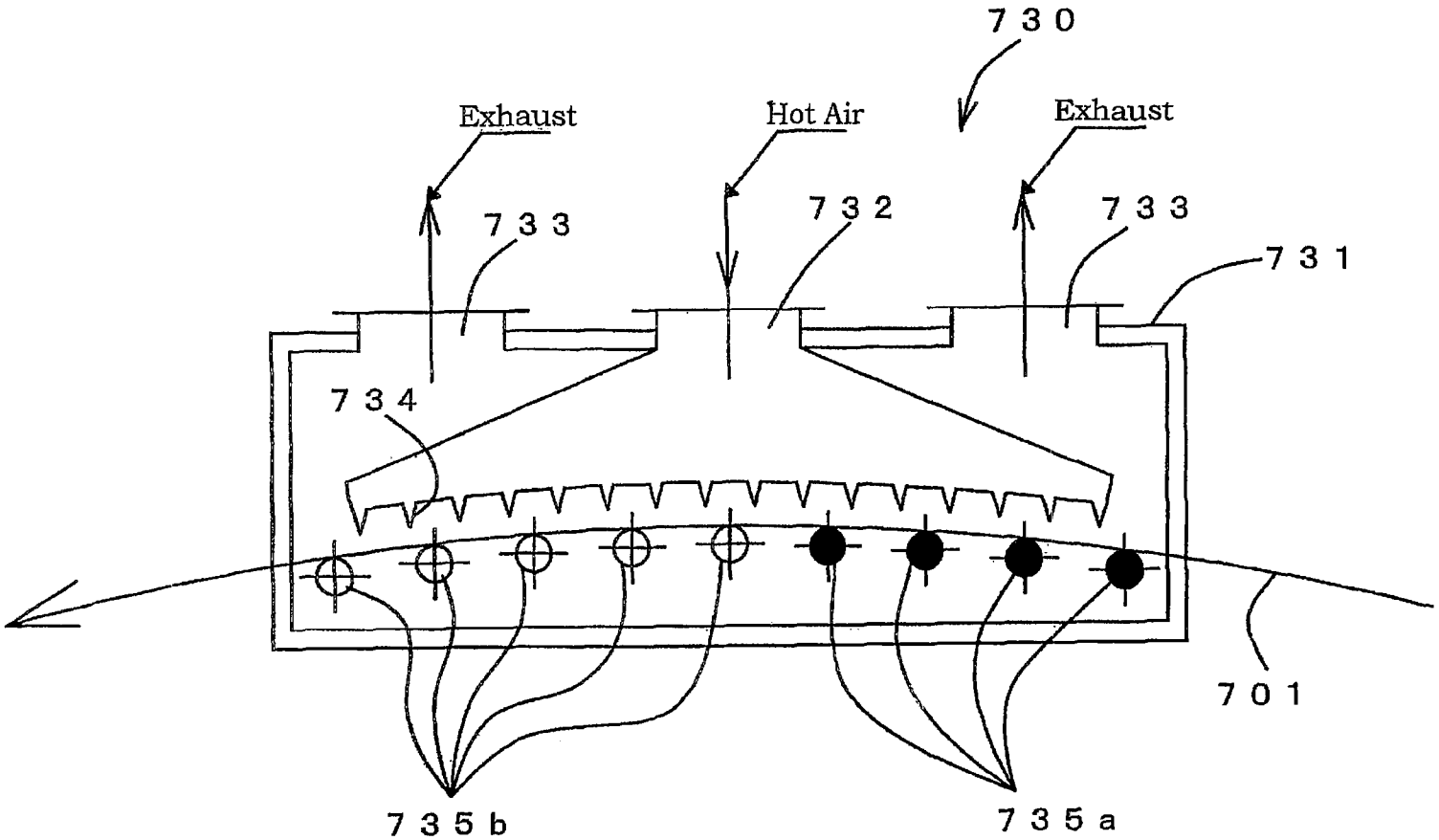
FIG. 4 Schematic view illustrating the drying means in the first zone of the drying oven FIG. 5 schematic view illustrating the heating and cooling means of the guide rolls at the first zone of the drying oven FIG. 6 Schematic view of coating apparatus wherein six drying ovens are connected in series (six zones)
Figure 5:
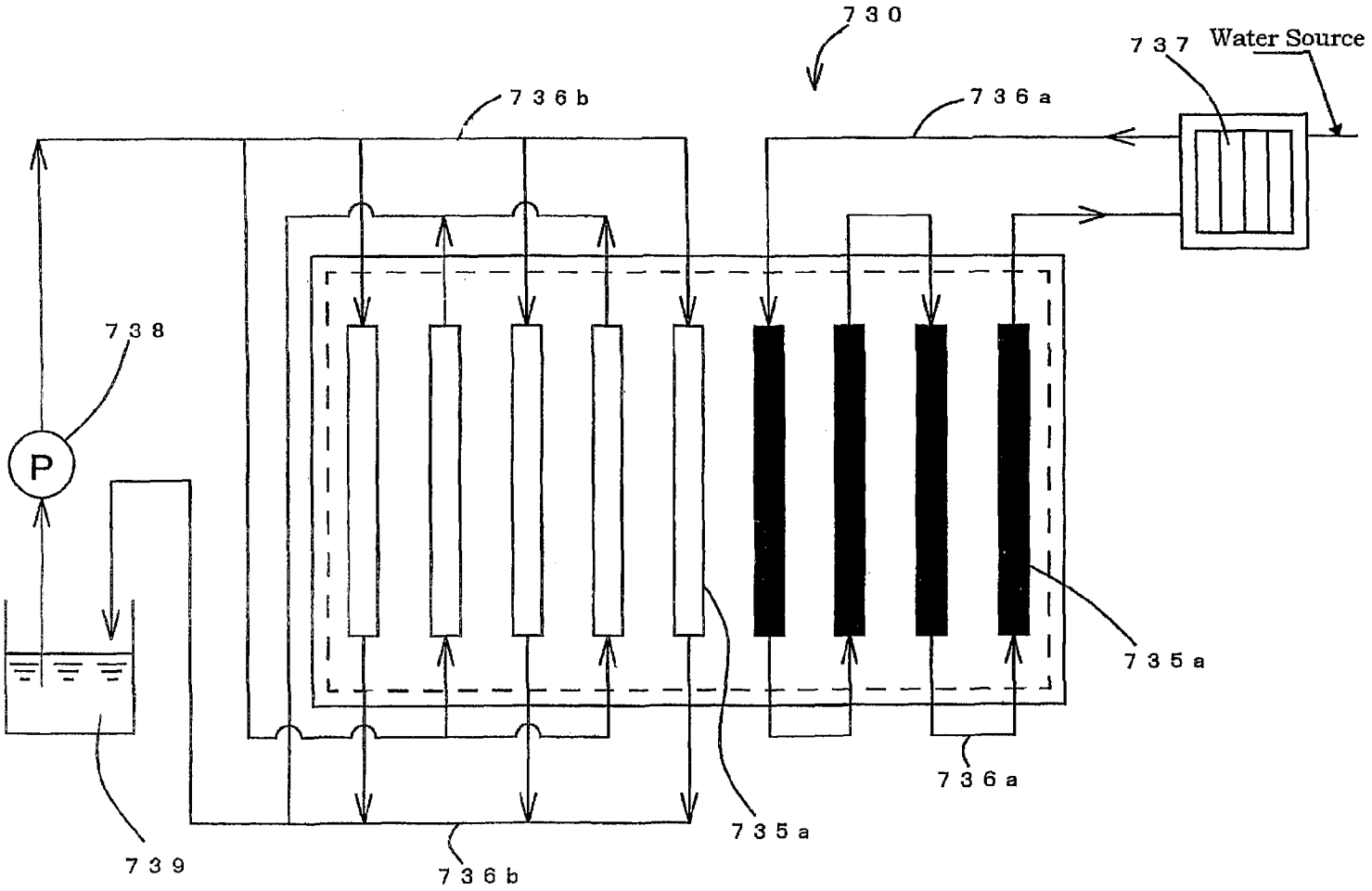

FIG. 3 is a schematic view of a general dry laminating machine wherein three drying ovens are connected in series (three zones), FIG. 4 is a schematic view illustrating the first zone drying oven, and FIG. 5 is a drawing illustrating an example of the layout of the heating guide rolls and the cooling guide rolls.

In FIG. 3, the dry laminating machine 700 is constructed by a substrate delivery portion 710, a coating portion 720, a drying oven 730, a laminating portion 740 and a winding portion 750. The substrate A 701 unwound from the substrate delivery portion 710 is conveyed with being nipped by a gravure roll 721 and a rubber roll 722, and an adhesive 702 is applied by the gravure roll 721. 723 is a doctor knife. The substrate A 701 applied with the adhesive is delivered to the drying oven 730, and the solvent is evaporated there. Then, in the laminating portion 740, it is superposed with a substrate B 703, and pressed to be laminated by a heating metal roll 741 and a back-up roll 742. Then, they are cooled by a cooling metal roll 743, and wound in the winding portion 750.

The above drying oven 730 is, as shown in FIG. 4, provided with a sealed box 731, and the sealed box 731 is provided with a hot air introducing port 732 and a hot air exhaust port 733, and a plurality of nozzles 734 for hot air blow-off are connected to the hot air introducing port 732. Moreover, a plurality nine guide rolls 735 are provided in the conveying direction of the substrate A 701. The former 4 guide rolls 735 (upstream side in the conveying direction, the right side in the figure) are made heating guide rolls 735*a*, and the latter 5 guide rolls 735 (downstream side in the conveying direction, the left side in the figure) are made cooling guide rolls 735*b*.

These heating guide rolls 735*a* are, as shown in FIG. 5, connected in series through a pipe 736*a*, and the end is connected to a hot water heating apparatus 737. Thus, the hot water heated by the hot water heating apparatus 737 circulates the heating guide rolls 735*a* successively. The cooling guide rolls 735*b* are connected in parallel through pipes 736*b*, and the pipes 736*b* on the cooling water introducing side are connected to a pump 738, and the pipes 736*b* on the cooling water discharging side are connected to a chiller cooled water tank 739. Therefore, the chiller cooled water is delivered to respective cooling guide rolls 735*b* by the pump 738, and the cooling water of which the temperature is elevated by passing through the cooling guide rolls 735*b* is returned to the chiller cooled water tank 739.

Figure 6:
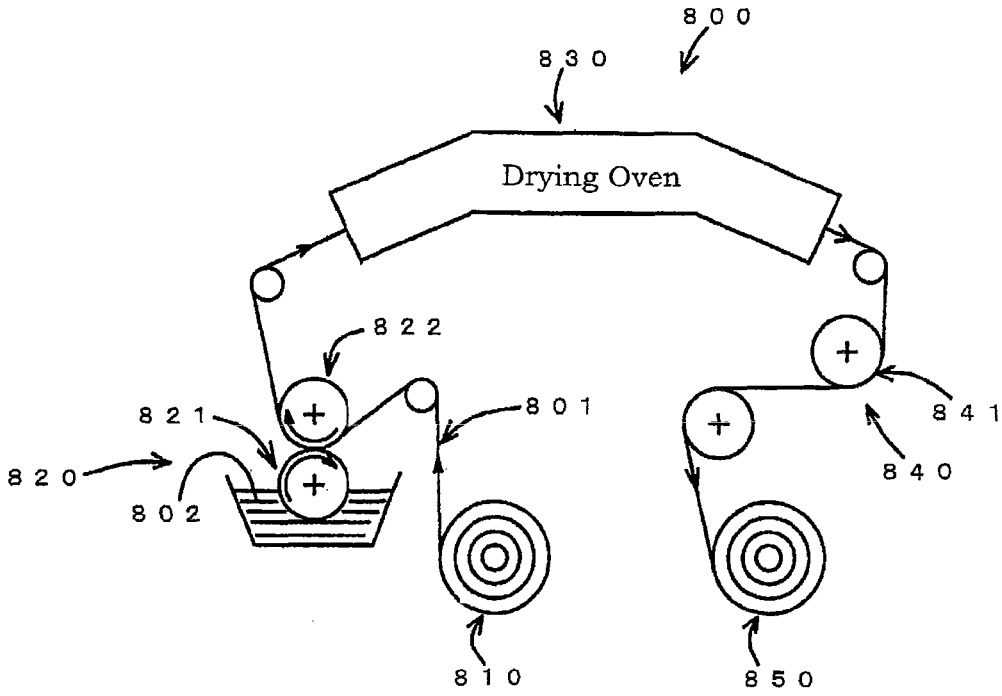

An embodiment of the method of drying a coating liquid agent of the invention which is applied to coating is explained with reference to the drawing. FIG. 6 is a schematic view of a general coating machine wherein six drying ovens are connected in series (6 zones).

In FIG. 6, the coating machine 800 is constructed by a substrate delivery portion 810, a coating portion 820, a drying oven 830, a cooling portion 840 and a winding portion 850. The substrate unwound from the substrate delivery portion 810 is conveyed with being nipped by a gravure roll 821 and a rubber roll 822, and a coating agent 802 is applied by the gravure roll 821. The substrate 801 applied with the coating agent 802 is delivered to the drying oven 830, and the solvent is evaporated there. Then, it is cooled by a cooling roll 841 in the cooling portion 840, and wound in the winding portion 850.

The above drying oven 830 has a similar construction to the aforementioned drying oven 730 in the dry laminating machine 700.

Example 1

Hereafter, an example of the invention applied to gravure printing is explained in more detail, but the present invention is not limited to the example.

The example was conducted by modifying an existing five color gravure printing machine. That is, as mentioned previously, among 9 guide rolls in the drying portion 220, the former 4 rolls were made heating guide rolls 223*a*, and liquid delivery pipes 224*a* for injecting hot water and discharge pipes 224*a* for discharging the hot water were connected. Furthermore, a motor valve 225*a* for adjusting the flow rate of hot water and a heating unit 226*a* were also connected.

The latter 5 rolls were made cooling guide rolls 223*b*, and liquid delivery pipes 224*b* for injecting cooling water and a liquid delivery pipe 232 for injecting cooling water into the cooling roll 231 in the cooling portion 230 were connected. Furthermore, a motor valve 225*b* for adjusting the flow rate and a cooling unit 226*b* were also connected. It was further modified by providing a driving motor 241 and a driving belt 242 so that the circumferential speed of the guide rolls 223*a*, 223*b* and the cooling roll 231 was identical with the conveying speed of the raw web (substrate).

Gravure rolls each having a 2.0 mm square-lattice-shaped pattern carved on a plate cylinder by the electroengraving of helio-gravure (screen ruling: 175 lines, stylus angle: 130°), were set in the five color gravure printing machine so modified. Respective inks of white (pigment content: 20%), yellow (pigment content: 12%, red (pigment content: 12%), blue (pigment content: 12%) and black (pigment content: 12%) were prepared using water-soluble inks HYDRIC PRP-401 manufactured by Dainichi Seika Color & Chemicals Manufacturing Co., Ltd. (dispersions of pigment in an acrylic resin vehicle) by adding 40 parts by volume of a diluent solvent HYDRIC 5032 SOLVENT (50 parts by volume of methanol, 30 parts by volume of isopropyl alcohol, 20 parts by volume of water).

An OPP film manufactured by Tocello Kabushiki Kaisha (thickness: 20 μm, width: 1000 mm, windings: 2000 m, corona treatment on one side) was set in the feeder 100 of the five color gravure printing machine as the printing raw web 1, and layer printing of the square lattice-shaped pattern was conducted on the corona-treated surface at a printing speed of 200 m/min with a tension of 8.0 kg/1000 mm width in the order of white (the first printing unit 200), yellow (the second printing unit 300), red (the third printing unit 400), blue (the fourth printing unit 500) and black (the fifth printing unit 600), successively.

The hot air used in the drying portion 220, 320, 420, 520, 620 was at 130° C. at 70 $m^3$/min for the first printing unit 200 and at 130° C. at 70 $m^3$/min for the second printing unit 300 and thereafter.

Hot water at 85° C. was supplied to the heating guide roll 223*a* through the motor valve 225*a*, and cooling water at 20° C. was supplied to the cooling guide rolls and the cooling roll 231 through the motor valve 225*b*.

Printing was conducted like this, and temperatures before entering each printing unit and temperatures at the exit of each printing unit immediately after the cooling portion were measured, and it was checked whether or not the temperature of the raw web became almost the same on printing of each color from the first color to the fifth color. The temperatures were measured by using a radiation thermometer. Moreover, prints were observed by naked eye to examine the presence or absence squeeze-out of color in the square lattice-shaped pattern (the squeeze-out of color occurs, when print slippage occurs). The measured results are shown in Table 2.

TABLE 2

Raw web temperatures in water-soluble gravure printing

| Printing Unit | Measured Position: Before Entering Printing Unit | Measured Position: Exit of Printing Unit |
|---|---|---|
| First Printing Unit | 25° C. | 27° C. |
| Second Printing Unit | 26° C. | 27° C. |
| Third Printing Unit | 27° C. | 28° C. |
| Fourth Printing Unit | 27° C. | 28° C. |
| Fifth Printing Unit | 27° C. | 28° C. |
| Sixth Printing Unit | 27° C. | 28° C. |

[Temperature of Raw Web Upon Printing]

The temperatures of the raw web at the exit of printing unit are almost the same as those before entering printing unit. The heat supplied in the drying portion is cooled by the cooling guide rolls in the drying portion and the cooling roll in the cooling portion, and temperature elevation of the raw web is very small. Accordingly, the temperature of the raw web upon printing (before entering the printing unit) is almost the same from the first color to the fifth color.

[Observation of Prints by Naked Eye]

Prints 2000 m in length produced by layer printing of the suquare lattice-shaped pattern in the order of white-yellow-red-blue-black were observed by naked eye, the lattice-shaped pattern in black by the last printing was printed clearly from the first to the last, and squeeze-out of color could not been found. Therefore, print slippage did not occur.

[Printing Speed]

As mentioned above, although the printing was carried out at a printing speed of 200 m/min, it could be performed with equivalent quality to conventional printing. Therefore, the printing speed was about 1.7 times the conventional printing speed (120 m/min).

Example 2

Hereafter, an example of the invention applied to dry laminating is explained in more detail, but the present invention is not limited to the example.

An existing dry laminating machine having two zones formed by connecting drying ovens each 3.5 m in length in series was modified. Among 10 guide rolls in the first zone, the former four rolls were made heating guide rolls, and liquid delivery pipes for injecting hot water and discharge pipes for discharging the hot water were connected. Furthermore, a motor valve for adjusting the flow rate and a heating unit were also connected. The latter six guide rolls and all of ten rolls in the second zone were made cooling rolls, and liquid delivery pipes for injecting cooling water and discharge pipes for discharging the cooling water were connected. Furthermore, a motor valve for adjusting the flow rate and a cooling unit were also connected. Moreover, a driving motor and a driving belt were provided so as to force driving the heating guide rolls and the cooling guide rolls to render them to have the same speed as the conveying speed of the substrate.

A gravure roll produced by carving a plate cylinder by the electroengraving of helio-gravure (screen ruling: 95 lines, stylus angle: 130°) was set as the plate cylinder in the dry laminating machine so modified, and an urethane adhesive (principal agent: TM 569, curing agent: CAT-RT 37, solvent: ethyl acetate) manufactured by Toyo Morton, Ltd. was applied to O-NY film (N1130, 15 μm) manufactured by Toyobo Co., Ltd. on which 5.0 cm square-lattice-shaped pattern was printed. Then, it was dried at a processing speed of 150 m/min at a temperature of 110° C. and an air flow of 60 $m^3$/min in the first zone, and at a temperature of 110° C. and an air flow of 20 $m^3$/min in the second zone. To the heating guide rolls, hot water at 70° C. was supplied through the motor valve, and to the cooling guide rolls, cooling water at 20° C. was supplied through the motor valve. Onto the surface coated with the adhesive of the dried O-NY, an LLDPE film (TUX-HZ, 50 μm) manufactured by Tocello Kabushiki Kaisha was superposed, and laminated at a nip pressure of 18 kg·cm as line pressure.

Dry lamination was carried out like this, and concentrations of organic solvent (ethyl acetate) gas were measured in the exhaust of the first zone and in the exhaust of the second zone to confirm the performance of the invention, and estimate the reduction of $CO_2$. Moreover, the presence or absence of deformation was confirmed by the observation of appearance of the laminate, and the presence or absence of elongation or contraction was confirmed by measuring the size of the square-lattice-shaped pattern of print.

[Confirmation of Performance of the Invention]

The concentrations of ethyl acetate gas in the exhaust of the first zone and in the exhaust of the second zone were measured by using an inflammable gas concentration meter RM-571A (Detector: GD-D8) manufactured by RIKEN KEIKI Co., Ltd., and compared with a conventional dry laminating machine having three zones.

The results are shown in Table 3.

TABLE 3

| | | Zone | | | | | | | | |
|---|---|---|---|---|---|---|---|---|---|---|
| | | First | | | Second | | | Third | | |
| | Item | Air Flow $m^3$./min | Temp. ° C. | Ethyl Acetate % | Air Flow $m^3$./min | Temp. ° C. | Ethyl Acetate % | Air Flow $m^3$./min | Temp ° C. | Ethyl Acetate % |
| Method | Processing Speed in the Invention 150 m/min | 60 | 110 | 0.84 | 20 | 110 | 0.0 | — | — | — |
| | Processing Speed in the Conventional Method 120 m/min | 100 | 70 | 0.32 | 100 | 80 | 0.15 | 100 | 90 | 0.0 |

In the invention, ethyl acetate was evaporated off in the first zone due to the high hot air temperature, and it did not remain in the second zone. Contrarily, in the conventional method, it was still evaporated also in the second zone. Therefore, since the conventional three zone system can be changed by two zone system, equipment becomes compact to be supplied inexpensively.

[Estimate of $CO_2$ Reduction]

The total heat quantity of hot air was calculated in the case of the invention wherein processed under the above conditions and in the case of conventional three zone system, and the difference was estimated as the reduction of $CO_2$.

The invention:

Calculation was conducted under the conditions that the exhaust of the second zone was circulated to the first zone, and the total exhaust flow was set at 63 $m^3$/min and the temperature of the exhaust was set at 100° C. The result is indicated in Mathematical 1.

$$63\ m^3/\text{min} \times \underset{(\text{specific gravity})}{0.916} \times \underset{(\text{specific heat})}{0.2441} \times \underset{(\text{temp.})}{100} \times \underset{(\text{min})}{60} = 84{,}519\ \text{kcal/hr} \quad \text{[Mathematical 1]}$$

Conventional Method:

Calculation was conducted under the conditions that the exhaust of the third zone was circulated to the second zone, and the exhaust of the second zone to the first zone, and the total exhaust flow was set at 128 $m^3$/min and the temperature of the exhaust was 70° C. The result is indicated in Mathematical 2.

$$128\ m^3/\text{min} \times \underset{(\text{specific gravity})}{0.996} \times \underset{(\text{specific heat})}{0.2432} \times \underset{(\text{temp.})}{70} \times \underset{(\text{min})}{60} = 130{,}221\ \text{kcal/hr} \quad \text{[Mathematical 2]}$$

As descried above, the heat quantity for the three zone system being a conventional method is 130,221 kcal/hr, and in contrast, that for the invention is 84,519 kcal/hr and fuel (LPG gas, heavy oil) can be saved corresponding to the difference of heat quantity, i.e. 130,221−84,519=45,702 kcal/hr.

[Presence or Absence of Deformation and Contraction in Appearance]

The presence or absence of deformation was confirmed by the visual observation of the appearance of laminate, and the presence or absence of contraction was confirmed by measuring the O-NY with the square-lattice pattern print at a definite distance before lamination and that after lamination.

As a result, it had normal appearance without deformation, such as curling or wrinkles. Moreover, contraction occurred little. The results of contraction are shown in Table 4.

TABLE 4

| Presence or Absence of Contraction | | |
|---|---|---|
| | Sample | |
| Direction | Before Lamination | After Lamination |
| Longitudinal Direction (MD) | 900.0 mm | 900.5 mm |
| Lateral Direction (TD) | 900.0 mm | 899.5 mm |

Example 3

Hereafter, an example applied to coating is explained in more detail, but the present invention is not limited to the example.

An existing coating machine having six zones where six ovens each 3 m in length were connected in series was modified. All of ten rolls in the first zone were made heating guide rolls, and all guide rolls in the remaining 5 zones (each ten guide rolls) were made cooling guide rolls, and modified in the same manner as Example 2.

A gravure roll having a number of screen ruling of 200 lines, oblique line plate was set in the coating machine so modified. A thermosetting type silicone liquid (principal agent: KS-847, curing agent: CAT-PL-50T) manufactured by Shin-Etsu Chemical Co., Ltd. was diluted by a solvent (toluene 50%, MEK 50%) to prepare a coating solution having a silicone concentration of about 1.8%. The coating solution was applied to a PET film (25 μm) manufactured by Toyobo Co., Ltd. in reverse system, and dried at a processing speed of 150 m/min at 100° C.-10 $m^3$/min in the first zone, at 140° C.-10 $m^3$/min in the second zone, at 180° C.-10 $m^3$/min in the third, fourth and fifth zones, and at 120° C.-10 $m^3$/min in the sixth zone. Then, it was cooled by the cooling roll, and then, wound up. Hot water at 85° C. was supplied to the heating guide rolls, and cooling water at 20° C. was supplied to the cooling guide rolls, similar to Example 2.

[Performance of Coated Film]

Appearance:

It was clear without whitening, and curing had been finished (if uncured, whitening occurs). Moreover, deformation, such as waviness, did not occur.

Measurement of Peeling Force:

An adhesive tape No. 31B (50 mm width) manufactured by Nitto Denko Co., Ltd. was laminated with the coated PET film at a nip pressure of 5 kg/50 mm width, and allowed to stand at 70° C.-20 hours with a load of 20 g/$cm^2$. Then, the peeling force was measured by a tensile tester, and found to be a normal peeling force of 60 g/50 mm width.

[Improvement in Processing Speed]

Since thermosetting is a chemical reaction, the higher the temperature is, the faster the reaction rate is (in general, 2-3 times/10° C.). However, in the conventional method, when hot air temperature was raised to 150° C. or more, deformation (waviness, wrinkle) occurred at the end of PET film. Therefore, the temperature was at 150° C. or less, and the upper limit of the processing speed was 100 m/min.

In the invention, when hot air temperature was raised to 180° C., deformation did not occur due to cooling the opposite side of substrate. Therefore, processing speed could be raised to 150 m/min, and thereby, productivity could be improved.

| [Description of Reference Signs] | |
|---|---|
| 1 | Raw Web |
| 100 | Feeder |
| 200 | First Printing Unit |
| 220 | Drying Portion |
| 221 | Hot Air Blow-Off Nozzle |
| 223a | Heating Guide Roll |
| 223b | Cooling Guide Roll |
| 226a | Heating Unit |
| 226b | Cooling Unit |
| 700 | Dry Laminating Machine |
| 735a | Heating Guide Roll |
| 735b | Cooling Guide Roll |
| 800 | Coating Machine |
| 830 | Heating Oven |

The invention claimed is:

1. A method of drying a coating liquid agent which comprises, applying uniformly a liquid agent made by dissolving an aqueous or solvent-characteristic component to a substrate by a coating roll, and then, blowing hot air toward the liquid agent-applied side while conveying the substrate with contacting a plurality of guide rolls with the opposite side to the liquid agent-applied side in a drying oven, wherein former portion of the plurality of guide rolls is made heating guide rolls, and remaining latter portion is made cooling guide rolls, the substrate immediately after entering the drying oven is heated by the heating guide rolls to render it at a temperature of boiling point of water or solvent or higher than that, and thereafter, the substrate is cooled by the cooling guide rolls so as to keep a temperature where the substrate is not deformed.

2. The method of drying a coating liquid agent as set forth in claim 1, wherein temperature of said substrate before drying is detected, and temperature of the cooling guide rolls is adjusted so that temperature of the substrate after drying is made similar to the detected temperature of the substrate before drying.

3. The method of drying a coating liquid agent as set forth in claim 1, wherein said heating guide rolls are heated by injecting hot water or heating oil, and said cooling guide rolls are cooled by injecting cooling water.

4. The method of drying a coating liquid agent as set forth in claim 1, wherein said heating guide rolls and cooling guide rolls are forced to drive to synchronize them with conveying speed of the substrate.

* * * * *

UNITED STATES PATENT AND TRADEMARK OFFICE

CERTIFICATE OF CORRECTION

PATENT NO. : 8,545,941 B2
APPLICATION NO. : 13/286683
DATED : October 1, 2013
INVENTOR(S) : Shunichiro Nakamoto et al.

It is certified that error appears in the above-identified patent and that said Letters Patent is hereby corrected as shown below:

ON THE TITLE PAGE and IN THE SPECIFICATION:

Title, item (54) and at column 1, lines 1-2, should read as follows:

--METHOD OF DRYING COATING SOLUTION AND APPARATUS THEREFOR--.

Signed and Sealed this
Eighteenth Day of February, 2014

Michelle K. Lee

Michelle K. Lee
*Deputy Director of the United States Patent and Trademark Office*